US012680545B2

(12) United States Patent
Kawamura et al.

(10) Patent No.: US 12,680,545 B2
(45) Date of Patent: Jul. 14, 2026

(54) SCREW COMPRESSOR

(71) Applicant: Hitachi, Ltd., Tokyo (JP)

(72) Inventors: Hironobu Kawamura, Tokyo (JP); Sachio Sekiya, Tokyo (JP); Hiroshi Maita, Tokyo (JP); Haruki Nukaga, Tokyo (JP); Kento Hashimoto, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 19/257,634

(22) Filed: Jul. 2, 2025

(65) Prior Publication Data

US 2026/0117771 A1 Apr. 30, 2026

(30) Foreign Application Priority Data

Oct. 31, 2024 (JP) ..... 2024-191399

(51) Int. Cl.

| | |
|---|---|
| ***F04C 28/00*** | (2006.01) |
| ***F04C 15/00*** | (2006.01) |
| ***F04C 18/06*** | (2006.01) |
| ***F04C 29/00*** | (2006.01) |

(52) U.S. Cl.

CPC ..... *F04C 28/00* (2013.01); *F04C 15/0096* (2013.01); *F04C 18/06* (2013.01); *F04C 29/0092* (2013.01); *F04C 2270/185* (2013.01); *F04C 2270/195* (2013.01)

(58) Field of Classification Search

CPC ..... F04C 28/00; F04C 15/0096; F04C 18/06; F04C 29/0092; F04C 2270/185; F04C 2270/195

See application file for complete search history.

(56) References Cited

U.S. PATENT DOCUMENTS

| | | | | |
|---|---|---|---|---|
| 8,529,234 | B2 * | 9/2013 | Yoshimura | F04C 18/16 418/104 |
| 2011/0135528 | A1 * | 6/2011 | Amano | F04C 18/16 418/206.6 |
| 2013/0195649 | A1 * | 8/2013 | Kitano | F16J 15/004 415/229 |
| 2015/0260187 | A1 | 9/2015 | Endo et al. | |
| 2024/0229794 | A1 * | 7/2024 | Simross | F04C 18/16 |

FOREIGN PATENT DOCUMENTS

| | | | |
|---|---|---|---|
| JP | 5138662 | B2 * | 2/2013 |
| JP | 5714945 | B2 | 5/2015 |

OTHER PUBLICATIONS

English Translation JP-5138662-B2 (Year: 2013).*
Extended European Search Report issued in European Application No. 25188689.1 dated Dec. 22, 2025 (8 pages).

* cited by examiner

*Primary Examiner* — Shafiq Mian
(74) *Attorney, Agent, or Firm* — Crowell & Moring LLP

(57) ABSTRACT

A screw compressor includes a first seal, a second seal, and a third seal which are non-contact seals from a rotor side to a bearing side of a shaft seal portion, a compressed gas supply device which is different from a rotor that supplies compressed gas between the first seal and the second seal, and a heating device that heats the compressed gas supplied between the first seal and the second seal from the compressed gas supply device.

4 Claims, 2 Drawing Sheets

SCREW COMPRESSOR

This application relates to and claims the benefit of priority from Japanese Patent Application No. 2024-191399 filed on Oct. 31, 2024, the entire disclosure of which is incorporated herein by reference.

BACKGROUND OF THE INVENTION

1. Field of the Invention

The present invention relates to a screw compressor that compresses water vapor.

2. Description of the Related Art

Conventionally, there has been known a screw compressor that compresses gas, in which a first non-contact seal, a second non-contact seal, and a contact-type lip seal are disposed from a compression chamber side toward a bearing side of a discharge-side shaft seal portion (see, for example, JP 5714945 B). Specifically, when gas is compressed by a rotor, the screw compressor injects water into the compression chamber to lubricate the rotor. In the screw compressor, a part of the gas compressed by the rotor is supplied to a space formed between the first non-contact seal and the second non-contact seal after dehumidification. A space formed between the second non-contact seal and the lip seal communicates with an atmosphere side.

According to the screw compressor, since the compressed gas is supplied to the space between the first non-contact seal and the second non-contact seal, it is possible to suppress leakage of water from the compression chamber to the discharge-side shaft seal portion. Further, according to this screw compressor, even if water from the compression chamber leaks into the space between the second non-contact seal and the lip seal, the water is released to the atmosphere side. The screw compressor prevents an occurrence of a situation in which water in the compression chamber reaches a bearing beyond the lip seal. The screw compressor can prevent breakage of the bearing caused by deterioration of lubricating oil of the bearing due to water.

SUMMARY OF THE INVENTION

Meanwhile, a screw compressor that compresses water vapor supplies high-pressure water vapor obtained by compressing water vapor with a rotor, from a discharge-side end portion of the rotor to a use side of the high-pressure water vapor through a discharge port of a casing. In such a screw compressor, when high-pressure water vapor is supplied to the use side, it is necessary to more effectively suppress leakage of high-pressure water vapor from the compression chamber to a shaft seal portion formed between the discharge-side end portion of the rotor and a bearing. Further, in the screw compressor, it is also necessary to prevent an occurrence of a situation in which condensed water in the shaft seal portion flows into the bearing side. Therefore, in such a screw compressor, it is also conceivable to adopt a configuration of the conventional screw compressor (see, for example, JP 5714945 B).

However, in the conventional screw compressor, gas compressed by the rotor is used for suppressing leakage of water from the compression chamber to the shaft seal portion. Therefore, in the conventional screw compressor, the supply amount of the compressed gas to the use side decreases. In addition, since the conventional screw compressor uses the lip seal in contact with a rotation shaft of the rotor, the power loss due to the seal frictional resistance increases, and the efficiency of the screw compressor decreases. In addition, in the screw compressor that compresses water vapor, although it is desired to suppress the generation of condensed water in the shaft seal portion, it is not possible to sufficiently suppress the generation of condensed water in the shaft seal portion only by supplying the dehumidified compressed gas to the shaft seal portion in the conventional screw compressor.

Thus, a screw compressor that compresses water vapor is desired to be capable of sufficiently securing a supply amount of high-pressure water vapor to the use side, being excellent in efficiency of the screw compressor, and being capable of sufficiently suppressing generation of condensed water in the shaft seal portion.

An object of the present invention is to provide a screw compressor capable of sufficiently securing a supply amount of high-pressure water vapor to a use side, being more excellent in efficiency of the screw compressor than the related art, and being capable of sufficiently suppressing generation of condensed water in a shaft seal portion.

To solve the above problems, according to the present invention, a screw compressor includes a casing, a rotor that is disposed in the casing, compresses low-pressure water vapor sucked from one end side of the casing into high-pressure water vapor, and emits the high-pressure water vapor to the other end side of the casing, a rotation shaft of the rotor supported by a bearing, a shaft seal portion of the rotation shaft formed between the rotor and the bearing, and a plurality of seals arranged at predetermined intervals at the shaft seal portion of the rotation shaft on a discharge side along an axial direction of the rotation shaft, in which the plurality of seals includes a seal that increases flow resistance of a fluid passing between the seal and the rotation shaft and is not in contact with the rotation shaft, and includes at least a first seal, a second seal, and a third seal from a rotor side toward a bearing side of the shaft seal portion, and a compressed gas supply device that supplies compressed gas between the first seal and the second seal and is different from the rotor, and a heating device that heats the compressed gas supplied between the first seal and the second seal from the compressed gas supply device are provided.

According to the screw compressor of the present invention, it is possible to provide a screw compressor capable of sufficiently securing a supply amount of high-pressure water vapor to a use side, being more excellent in efficiency of the screw compressor than the related art, and being capable of sufficiently suppressing generation of condensed water in a shaft seal portion.

DESCRIPTION OF THE PREFERRED EMBODIMENTS

Modes (embodiments) for carrying out a screw compressor of the present invention will be described in detail with reference to the drawings as appropriate.

Hereinafter, a screw compressor of water vapor that compresses low-pressure water vapor into high-pressure water vapor and supplies the high-pressure water vapor to a use side will be described.

Figure 1:
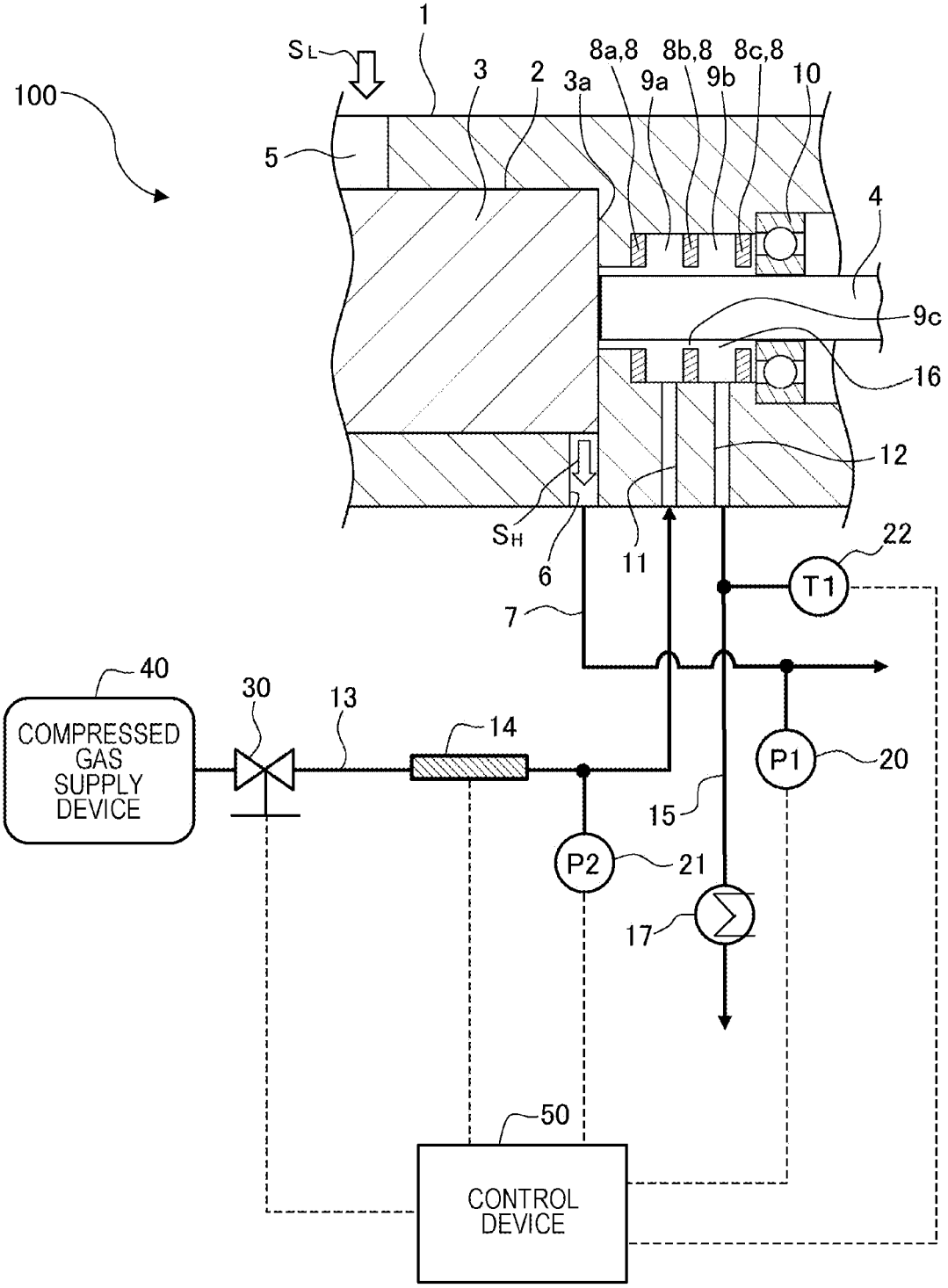
FIG. 1 is an explanatory view of a configuration of a screw compressor according to an embodiment of the present invention.

FIG. 1 schematically illustrates a cross-sectional structure of a screw compressor 100 on a side (may be simply referred to as a discharge side below) from which water vapor (high-pressure water vapor) compressed by a rotor 3 is discharged, and other main devices and components. In FIG. 1, for convenience of drawing, illustration of an end portion on a suction side of the screw compressor 100 is omitted except for a part where a suction port 5 for low-pressure water vapor is formed.

As illustrated in FIG. 1, the screw compressor 100 of the present embodiment includes the rotor 3, a rotation shaft 4 of the rotor 3, a casing 1 that houses the rotor 3 and the rotation shaft 4, and a bearing 10 that supports the rotation shaft 4 in the casing 1.

As illustrated in FIG. 1, the screw compressor 100 includes a shaft seal portion 16 formed in the casing 1 to surround the rotation shaft 4 between an end portion 3*a* (discharge-side end portion) on the discharge side of the rotor 3 and the bearing 10 on the discharge side.

As described above, in FIG. 1, the rotation shaft 4 and the bearing 10 only on the discharge side are illustrated, and the rotation shaft and the bearing on the suction side disposed symmetrically with the rotor 3 therebetween are not illustrated.

The rotor 3 is a so-called screw rotor, and includes a male rotor and a female rotor (not illustrated). Each of the male rotor and the female rotor has teeth (lobes) twisted in a screw shape. The male rotor and the female rotor rotate as the teeth of the mal rotor and the teeth of the female rotor mesh with each other. As a result, the rotor 3 compresses low-pressure water vapor sucked from a suction port 5 which will be described later to generate high-pressure water vapor, and sends out the high-pressure water vapor to the end portion 3*a* (discharge-side end portion) side on the discharge side of the rotor 3.

The rotation shaft on the discharge side denoted by the reference sign 4 extends from the end portion 3*a* (discharge-side end portion) on the discharge side of the rotor 3 and is rotatably supported by the bearing 10 in the casing 1.

The rotation shaft (not illustrated) on the suction side extends from an end portion (not illustrated) on the suction side of the rotor 3 and is rotatably supported by a bearing (not illustrated). The rotation shaft on the suction side is joined to an electric motor (not illustrated) at a distal end further extending from the bearing. The rotor 3 is rotated by the electric motor.

As illustrated in FIG. 1, the casing 1 has the suction port 5. The suction port 5 is formed in the casing 1 to be adjacent to the end portion (not illustrated) on the suction side.

The casing 1 has a discharge port 6 to correspond to the end portion 3*a* on the discharge side of the rotor 3. The discharge port 6 discharges water vapor (high-pressure water vapor) compressed to a high pressure by the rotor 3.

In the casing 1, the shaft seal portion 16 is formed in a space surrounding the rotation shaft 4 between the end portion 3*a* (discharge-side end portion) on the discharge side of the rotor 3 and the bearing 10 on the discharge side.

In the shaft seal portion 16, a plurality of seals 8 of the rotation shaft 4 are arranged at predetermined intervals along the axial direction.

The seals 8 in the present embodiment include a first seal 8*a*, a second seal 8*b*, and a third seal 8*c* from the rotor 3 side toward the bearing 10 side. The number of seals 8 may be four or more.

The seals 8 includes only seals that are not in contact with the rotation shaft 4 and increase the flow resistance of a fluid passing between the seal 8 and the rotation shaft 4.

In the shaft seal portion 16, a first space 9*a* is formed between the first seal 8*a* and the second seal 8*b*. In the shaft seal portion 16, a second space 9*b* is formed between the second seal 8*b* and the third seal 8*c*.

The first space 9*a* and the second space 9*b* communicate with each other via a gap 9*c* formed between the rotation shaft 4 and the second seal 8*b*.

The casing 1 is formed with a compressed gas supply port 11 that supplies compressed gas which will be described later to the first space 9*a*. The casing 1 is further formed with a compressed gas emission port 12 that emits the compressed gas flowing into the second space 9*b* from the first space 9*a* through the gap 9*c* to the outside of the casing 1.

A first pipe 7 is connected to the discharge port 6 of the casing 1. A second pipe 13 is connected to the compressed gas supply port 11 of the casing 1. A third pipe 15 is connected to the compressed gas emission port 12 of the casing 1.

A first pressure sensor 20 that detects a first pressure P1 that is a pressure of high-pressure water vapor flowing through the first pipe 7 is provided in the middle of extension of the first pipe 7.

The second pipe 13 connects the compressed gas supply port 11 and the compressed gas supply device 40. The compressed gas supply device 40 supplies the compressed gas to the first space 9*a* of the shaft seal portion 16 via the second pipe 13. The compressed gas supply device 40 corresponds to a "compressed gas supply device different from the rotor".

The compressed gas supply device 40 in the present embodiment is assumed to be, for example, an air compressor, a high-pressure gas cylinder, or the like, and is not limited thereto.

In the middle of the extension of the second pipe 13, a flow rate adjusting valve 30 that adjusts the flow rate of the compressed gas flowing through the second pipe 13, a heating device 14 that heats the compressed gas supplied to the first space 9*a*, and a second pressure sensor 21 that detects a second pressure P2 that is a pressure of the compressed gas flowing through the second pipe 13 on the downstream side of the heating device 14 are provided in order from the compressed gas supply device 40 side. The heating device 14 in the present embodiment is assumed to be an electric heater, and is not limited thereto.

A temperature sensor 22 that detects a temperature T1 of the compressed gas emitted from the compressed gas emission port 12 is provided on the immediately downstream side of the compressed gas emission port 12 of the third pipe 15.

A heat exchanger 17 is provided on the downstream side of the temperature sensor 22 in the third pipe 15.

The screw compressor 100 of the present embodiment includes a control device 50 that controls the supply amount of the compressed gas supplied from the compressed gas supply device 40 to a space between the first seal 8*a* and the second seal 8*b* such that the second pressure P2 illustrated in FIG. 1 is equal to or lower than the first pressure P1 illustrated in FIG. 1 (P1≥P2) and higher than the atmospheric pressure (P2>atmospheric pressure).

The control device 50 controls the heating amount by the heating device 14 such that the temperature T1 of the compressed gas detected by the temperature sensor 22 illustrated in FIG. 1 is higher than the saturation temperature of water calculated based on the first pressure P1 of the water vapor that has been compressed by the rotor 3 and flows through the first pipe 7 illustrated in FIG. 1.

Such a control device 50 can be configured to include a read only memory (ROM) that stores a predetermined program, a random access memory (RAM) that reads and loads the program stored in the ROM, and a central processing unit (CPU) that executes the loaded program and outputs commands to the flow rate adjusting valve 30 and the heating device 14.

A specific procedure executed by the control device 50 will be described together with the operation of the screw compressor 100.

Next, the operation of the screw compressor 100 (see FIG. 1) of the present embodiment will be described.

In the screw compressor 100 (see FIG. 1), when the rotor 3 (see FIG. 1) is rotated by the electric motor (not illustrated), the rotor 3 sucks low-pressure water vapor SL supplied in a predetermined path into a compression chamber 2 through the suction port 5.

The rotating rotor 3 sends out the sucked low-pressure water vapor Si to the end portion 3*a* on the discharge side of the rotor 3 while compressing the sucked low-pressure water vapor SL. High-pressure water vapor SH obtained by compression of the rotor 3 is supplied from the discharge port 6 to the use side of the high-pressure water vapor SH in a factory or the like via the first pipe 7.

On the other hand, the compressed gas supply device 40 supplies the compressed gas to the first space 9*a* via the second pipe 13 and the compressed gas supply port 11. At this time, the flow rate of the compressed gas is adjusted by the flow rate adjusting valve 30, and the compressed gas is heated by the heating device 14 to have a temperature which will be described later.

The flow rate of the compressed gas supplied to the first space 9*a* is adjusted by the flow rate adjusting valve 30, and the compressed gas is heated by the heating device 14 to have the second pressure P2.

As described above, the second pressure P2 is set to be equal to or less than the pressure of the end portion 3*a* on the discharge side of the rotor 3, that is, the first pressure P1 of the high-pressure water vapor SH flowing through the first pipe 7 connected to the discharge port 6. As described above, the second pressure P2 is set to be higher than the atmospheric pressure.

The compressed gas supplied to the first space 9*a* flows into the second space 9*b* via the gap 9*c*. The compressed gas flowing into the second space 9*b* is sent out from the compressed gas emission port 12 to the third pipe 15, and then discharged to the atmosphere side.

The exhaust heat of the compressed gas emitted from the compressed gas emission port 12 is recovered by the heat exchanger 17 provided in the middle of extension of the third pipe 15 on the downstream side of the temperature sensor 22. This exhaust heat can be used for heating feed water of a system (not illustrated) that supplies low-pressure water vapor to the screw compressor 100.

As described above, the control device 50 controls the opening degree of the flow rate adjusting valve 30 and the heating amount of the heating device 14 based on the temperature T1 of the compressed gas detected by the temperature sensor 22, the first pressure P1 detected by the first pressure sensor 20, and the second pressure P2 detected by the second pressure sensor 21.

Hereinafter, a procedure executed by the control device 50 (see FIG. 1) will be described mainly with reference to FIG. 2 with reference to the reference signs of FIG. 1.

Figure 2:
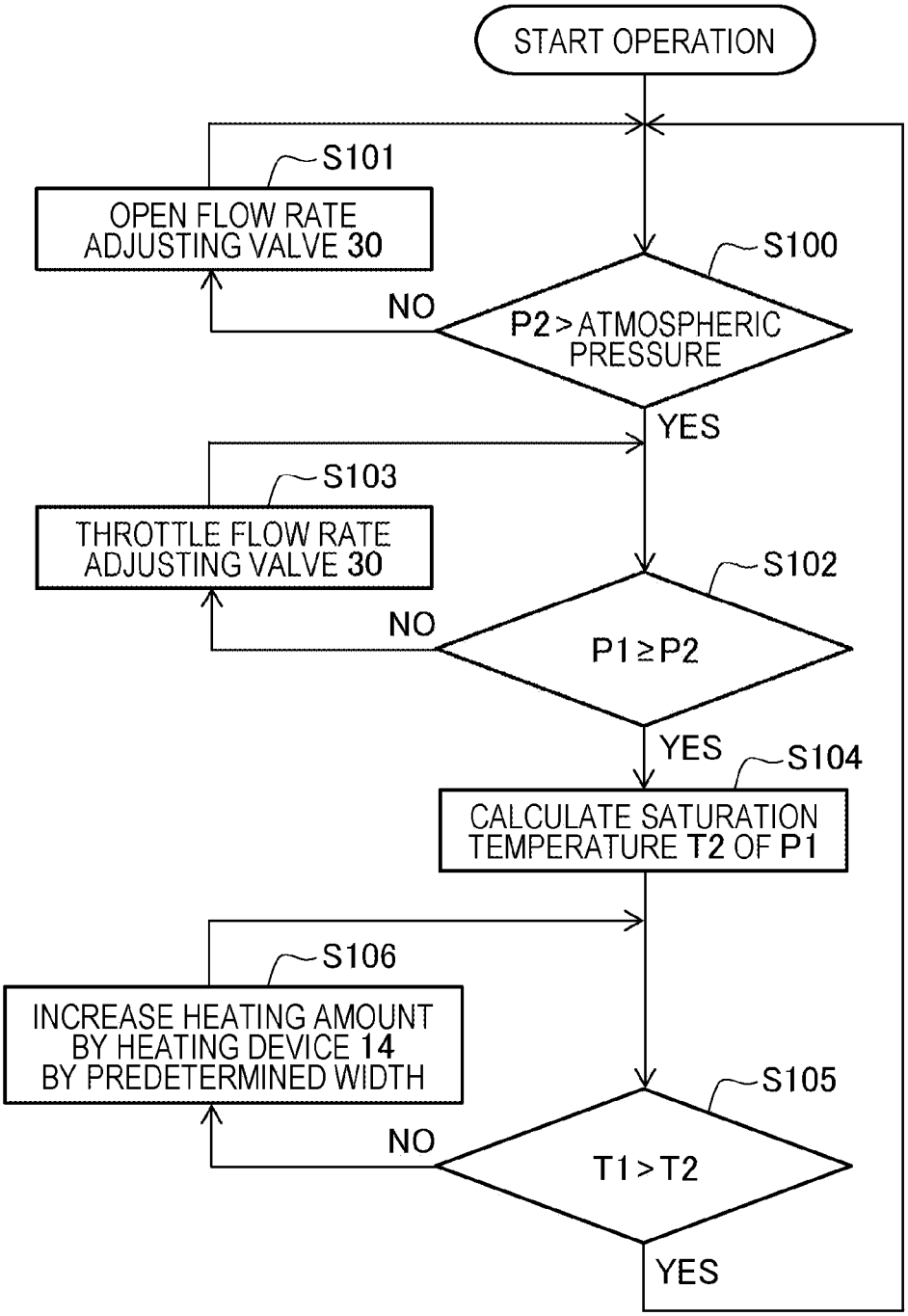
FIG. 2 is a flowchart illustrating a procedure executed by a control device constituting the screw compressor of FIG. 1.

FIG. 2 is a flowchart illustrating the procedure executed by the control device 50.

As illustrated in FIG. 2, when the operation of the screw compressor 100 is started, the control device 50 determines whether the second pressure P2 of the compressed gas flowing through the second pipe 13, which has been detected by the second pressure sensor 21, is higher than the atmospheric pressure (Step S100). When the second pressure P2 is equal to or lower than the atmospheric pressure (No in Step S100), the control device 50 commands the flow rate adjusting valve 30 to open (Step S101), and then returns to Step S100.

In Step S100, when the second pressure P2 is higher than the atmospheric pressure (Yes in Step S100), the control device 50 executes the procedure of the next Step S102.

In Step S102, the control device 50 determines whether the second pressure P2 of the compressed gas flowing through the second pipe 13, which has been detected by the second pressure sensor 21, is equal to or less than the first pressure P1 of the high-pressure water vapor SH flowing through the first pipe 7 connected to the discharge port 6.

When the second pressure P2 exceeds the first pressure P1 (No in Step S102), the control device 50 commands the flow rate adjusting valve 30 to throttle the flow rate adjusting valve 30 (Step S103), and then, returns to Step S102.

In Step S102, when the second pressure P2 is equal to or lower than the first pressure P1 (Yes in Step S102), the control device 50 calculates the saturation temperature T2 of water at the first pressure P1 (Step S104). In this calculation, a table indicating a correlation relationship between the pressure of water vapor and the saturation temperature T2 of water, which is stored in the ROM of the control device 50 is referred to.

After the procedure of Step S104 is executed, the control device 50 determines whether the temperature T1 of the compressed gas emitted to the third pipe 15, which has been detected by the temperature sensor 22, is higher than the saturation temperature T2 of water at the first pressure P1 (Step S105).

When the temperature T1 of the compressed gas emitted to the third pipe 15 is equal to or lower than the saturation temperature T2 of water at the first pressure P1 (No in Step S105), the control device 50 commands the heating device 14 to increase the heating amount by the heating device 14 with respect to the compressed gas flowing through the second pipe 13 on the downstream side of the flow rate adjusting valve 30 by a predetermined width (Step S106), and then, returns to Step S105.

In Step S105, when the temperature T1 of the compressed gas emitted to the third pipe 15, which has been detected by the temperature sensor 22, is higher than the saturation temperature T2 of water at the first pressure P1 (Yes in Step S105), the control device 50 returns to Step S100.

By executing the above procedure, the control device 50 controls the screw compressor 100 such that the second pressure P2 is equal to or lower than the first pressure P1 and higher than the atmospheric pressure, and controls the screw compressor 100 such that the temperature T1 of the compressed gas emitted to the third pipe 15 is higher than the saturation temperature T2 of water at the first pressure P1.

Operational Effects

Next, operational effects exhibited by the screw compressor 100 (see FIG. 1) of the present embodiment will be described.

In general, in a screw compressor in which water vapor is compressed by a rotor in a compression chamber to generate high-pressure water vapor, an end portion of the rotor is supported by a bearing, and both end portions of the compression chamber are configured by a compression chamber, a shaft seal portion, and a bearing in this order. In order to efficiently generate high-pressure water vapor, it is necessary to particularly suppress leakage of water vapor from the discharge side of the compression chamber to the shaft seal portion. In addition, when water vapor leaks from the compression chamber to the shaft seal portion on the discharge side, it is necessary to suppress an occurrence of a situation in which condensed water generated by a temperature decrease of the water vapor flows into the bearing side beyond the shaft seal portion. Water mixing with the lubricating oil of the bearing may lead to breakage of the bearing due to deterioration of the lubricating oil.

On the other hand, the screw compressor 100 of the present embodiment is a screw compressor 100 including a rotor 3 that is disposed in a casing 1, compresses low-pressure water vapor sucked from one end side of the casing 1 into high-pressure water vapor, and emits the high-pressure water vapor to the other end side of the casing 1, a rotation shaft 4 of the rotor 3 supported by a bearing 10, a shaft seal portion 16 of the rotation shaft 4 formed between the rotor 3 and the bearing 10, and a plurality of seals 8 arranged at predetermined intervals at the shaft seal portion 16 of the rotation shaft 4 on a discharge side along an axial direction of the rotation shaft 4, in which the plurality of seals 8 includes a seal that increases flow resistance of a fluid passing between the seal 8 and the rotation shaft 4 and is not in contact with the rotation shaft 4, and includes at least a first seal 8*a*, a second seal 8*b*, and a third seal 8*c* from the rotor 3 side toward the bearing 10 side of the shaft seal portion 16, and a compressed gas supply device 40 that supplies compressed gas between the first seal 8*a* and the second seal 8*b* and is different from the rotor 3, and a heating device 14 that heats the compressed gas supplied between the first seal 8*a* and the second seal 8*b* from the compressed gas supply device 40 are provided.

According to such a screw compressor 100, since the plurality of seals 8 include only seals not in contact with the rotation shaft 4, it is possible to reduce seal frictional resistance against the rotation shaft 4 unlike a conventional screw compressor (see, for example, JP 5714945 B) using a lip seal in contact with the rotation shaft. As a result, the screw compressor 100 can reduce the power loss, and the efficiency of the screw compressor is improved as compared with the conventional screw compressor.

In addition, since the screw compressor 100 includes the plurality of seals 8, it is possible to efficiently prevent an occurrence of a situation in which water reaches the bearing 10 from the shaft seal portion 16 beyond the seals 8.

According to the screw compressor 100, since the compressed gas is supplied between the first seal 8*a* and the second seal 8*b* by the compressed gas supply device 40, it is possible to suppress the leakage of the high-pressure water vapor from the compression chamber 2 to the shaft seal portion 16. As a result, the screw compressor 100 can improve efficiency and prevent generation of condensed water in the shaft seal portion 16 due to leaked water vapor.

According to the screw compressor 100, the compressed gas is supplied between the first seal 8*a* and the second seal 8*b* by the compressed gas supply device 40 different from the rotor 3. As a result, unlike the conventional screw compressor (see, for example, JP 5714945 B) in which gas compressed by the rotor is supplied to the shaft seal portion, the screw compressor 100 can sufficiently secure the supply amount of high-pressure water vapor to the use side, which is obtained by compression of the rotor 3.

According to the screw compressor 100, since the compressed gas supplied between the first seal 8*a* and the second seal 8*b* is heated by the heating device 14, it is possible to more reliably prevent the generation of the condensed water in the shaft seal portion 16.

The screw compressor 100 can have a configuration in which the casing 1 includes a discharge port 6 that discharges the high-pressure water vapor compressed by the rotor 3, and a compressed gas supply port 11 that supplies the compressed gas between the first seal 8*a* and the second seal 8*b*, and the screw compressor further includes a first pressure sensor 20 that detects a first pressure P1 of the water vapor that has been compressed by the rotor 3 and flows through a first pipe 7 connected to the discharge port 6, and a second pressure sensor 21 that detects a second pressure P2 of compressed gas flowing through a second pipe 13 connected to the compressed gas supply port 11, and a control device 50 that controls a supply amount of the compressed gas supplied between the first seal 8*a* and the second seal 8*b* from the compressed gas supply device 40 such that the second pressure P2 is equal to or lower than the first pressure P1 (P1≥P2) and higher than atmospheric pressure (P2>atmospheric pressure).

According to such a screw compressor 100, the compressed gas supplied between the first seal 8*a* and the second seal 8*b* does not flow back to the compression chamber 2 side. Even if condensed water caused by high-pressure water vapor leaking from the compression chamber 2 to a space between the first seal 8*a* and the second seal 8*b* is generated between the first seal 8*a* and the second seal 8*b*, the condensed water efficiently passes between the second seal 8*b* and the third seal 8*c* together with the compressed gas and is emitted to the atmosphere side.

The screw compressor 100 can further have a configuration in which the casing 1 includes a discharge port 6 that discharges the high-pressure water vapor compressed by the rotor 3, and a compressed gas emission port 12 that emits the compressed gas from a space between the second seal 8*b* and the third seal 8*c*, and the screw compressor further includes a temperature sensor 22 that detects a temperature T1 of compressed gas flowing through a third pipe 15 connected to the compressed gas emission port 12, and a control device 50 that controls a heating amount by the heating device 14 such that the temperature T1 of the compressed gas detected by the temperature sensor 22 is higher than a saturation temperature T2 of water calculated based on a first pressure P1 of high-pressure water vapor that flows through a first pipe 7 connected to the discharge port 6 and is compressed by the rotor 3.

According to such a screw compressor 100, since the temperature T1 of the compressed gas at the compressed gas emission port 12 is higher than the saturation temperature T2 of water at the first pressure P1 of the high-pressure water vapor at the discharge port 6, even if the high-pressure water vapor leaks from the compression chamber 2 into the shaft seal portion 16 beyond the first seal 8*a*, the compressed gas heated by the heating device 14 and then supplied between the first seal 8*a* and the second seal 8*b* is heated so that the high-pressure water vapor becomes an overheated state.

As a result, the screw compressor 100 prevents generation of condensed water due to the leaked high-pressure water vapor from the first space 9*a* to the second space 9*b*.

The screw compressor 100 can reliably prevent the occurrence of a situation in which water reaches the bearing 10 beyond the third seal 8*c*.

The screw compressor 100 can further have a configuration in which the casing 1 includes a compressed gas emission port 12 that emits compressed gas from a space between the second seal 8*b* and the third seal 8*c*, and the screw compressor further includes a heat exchanger 17 that recovers heat from the compressed gas flowing through a third pipe 15 connected to the compressed gas emission port 12 in the middle of extension of the third pipe 15.

In such a screw compressor 100, the exhaust heat recovered by the heat exchanger 17 can be used for heating feed water of a system (not illustrated) that supplies low-pressure water vapor to the screw compressor 100. According to the screw compressor 100, it is possible to further increase the efficiency of the screw compressor 100.

Although the embodiment of the present invention has been described above, the present invention is not limited to the above-described embodiment, and various modifications can be made without departing from the gist of the present invention.

What is claimed is:

1. A screw compressor comprising:

a casing;

a rotor that is disposed in the casing, compresses low-pressure water vapor sucked from one end side of the casing into high-pressure water vapor, and emits the high-pressure water vapor to the other end side of the casing;

a rotation shaft of the rotor supported by a bearing;

a shaft seal portion of the rotation shaft formed between the rotor and the bearing; and a plurality of seals arranged at predetermined intervals at the shaft seal portion of the rotation shaft on a discharge side along an axial direction of the rotation shaft, wherein the plurality of seals includes:

a seal that increases flow resistance of a fluid passing between the seal and the rotation shaft and is not in contact with the rotation shaft; and at least a first seal, a second seal, and a third seal from a rotor side toward a bearing side of the shaft seal portion, and a compressed gas supply device that supplies compressed gas between the first seal and the second seal and is different from the rotor, and a heating device that heats the compressed gas supplied between the first seal and the second seal from the compressed gas supply device are provided.

2. The screw compressor according to claim 1, wherein the casing includes a discharge port that discharges the high-pressure water vapor compressed by the rotor, and a compressed gas supply port that supplies the compressed gas between the first seal and the second seal, and the screw compressor further comprises:

a first pressure sensor that detects a first pressure of the high-pressure water vapor that has been compressed by the rotor and flows through a first pipe connected to the discharge port;

a second pressure sensor that detects a second pressure of compressed gas flowing through a second pipe connected to the compressed gas supply port; and a control device that controls a supply amount of the compressed gas supplied between the first seal and the second seal from the compressed gas supply device such that the second pressure is equal to or lower than the first pressure and higher than atmospheric pressure.

3. The screw compressor according to claim 1, wherein the casing includes a discharge port that discharges the high-pressure water vapor compressed by the rotor, and a compressed gas emission port that emits the compressed gas from a space between the second seal and the third seal, and the screw compressor further comprises:

a temperature sensor that detects a temperature of compressed gas flowing through a third pipe connected to the compressed gas emission port; and a control device that controls a heating amount by the heating device such that the temperature detected by the temperature sensor is higher than a saturation temperature of water calculated based on a first pressure of high-pressure water vapor that flows through a first pipe connected to the discharge port and is compressed by the rotor.

4. The screw compressor according to claim 1, wherein the casing includes a compressed gas emission port that emits compressed gas from a space between the second seal and the third seal, and the screw compressor further comprises a heat exchanger that recovers heat from the compressed gas flowing through a third pipe connected to the compressed gas emission port in the middle of extension of the third pipe.

* * * * *